United States Patent [19]

Aiello

[11] 4,414,121

[45] Nov. 8, 1983

[54] AQUEOUS LUBRICATING COMPOSITIONS

[75] Inventor: Robert P. Aiello, Cypress, Tex.

[73] Assignee: Shell Oil Company, Houston, Tex.

[21] Appl. No.: 330,415

[22] Filed: Dec. 14, 1981

[51] Int. Cl.[3] ..... C10M 1/06; C10M 1/28

[52] U.S. Cl. ..... 252/49.5; 252/33.3; 252/42.7

[58] Field of Search ..... 252/49.5, 33.3, 42.7

[56] References Cited

U.S. PATENT DOCUMENTS

| | | | |
|---|---|---|---|
| 2,952,343 | 9/1960 | Pitman | 252/33.3 |
| 3,117,930 | 1/1964 | Kukin et al. | 252/33.3 |
| 4,125,470 | 11/1978 | Fenton et al. | 252/33.3 |
| 4,354,949 | 10/1982 | Eggers et al. | 252/39 |
| 4,360,443 | 11/1982 | Durr, Jr. | 252/49.5 |

FOREIGN PATENT DOCUMENTS

| | | | |
|---|---|---|---|
| 659072 | 1/1948 | United Kingdom | 252/33.3 |

OTHER PUBLICATIONS

Bastian, Metal Working Lubricant, McGraw-Hill (1951) p. 16.

*Primary Examiner*—Delbert E. Gantz
*Assistant Examiner*—Asokkumar Pal
*Attorney, Agent, or Firm*—John M. Duncan

[57] ABSTRACT

Water-based metal-working lubricants containing an emulsion-type anionic, soluble oil comprising a low viscosity index (LVI) lubricating oil, sodium sulfonates as an emulsifier, a soluble oil coemulsifier base containing naphthenic acids, potassium hydroxide, anti-rust and anti-microbial agents and an effective amount of block copolymers of ethylene oxide and propylene oxide or other alkylene oxides having a molecular weight between about 800 and about 8,000.

9 Claims, No Drawings

AQUEOUS LUBRICATING COMPOSITIONS

BACKGROUND OF THE INVENTION

This invention relates to aqueous base, metal working lubricating compositions. More particularly, it relates to improved multipurpose waterbase metal cutting fluids for use in cutting, drilling, reaming and other machining and forming operations of ferrous and non-ferrous metals.

Cutting fields may be divided into two broad classes; mineral-oil fluids and soluble-oil fluids. The former are based on mineral-oil stocks, and are compounded in a ready-to-use form, while the latter are based on mineral oil, or other, stocks and are compounded as concentrates to be diluted with water at the point of use. Both classes of fluids frequently employ sulfur-, chlorine-, and phosphorus-containing additives as cutting aids. Which class of cutting fluid should be used in a given application depends generally upon whether the overall operation is best served by emphasizing lubrication (as with a mineral-oil fluid) or by emphasizing cooling (as with a soluble-oil fluid).

Soluble oils have been further divided into three, oftentimes rather indistinct, classes: heavy-duty, general-purpose, and synthetic fluids. When mixed with water these oils form emulsions which can range from true emulsions, as in the case where the soluble oils contain mostly oil-soluble components, to nearly true solutions, as in the case where the soluble oils contain mostly water-soluble components. In general, cutting fluids made from heavy-duty and general-purpose soluble oils are characteristically emulsion-like, while those made from synthetic soluble oils are solution-like, although it should be understood that the whole range of types of mixtures is possible. The term soluble oil is used herein to denote the fluid prior to dilution with water; after dilution, the fluid is called either an emulsion or a cutting fluid.

Heavy-duty fluids (sometimes called "semi-synthetic fluids") are opaque or translucent emulsions that contain some mineral oil in addition to antirust, extreme pressure (EP), antiwear and possibly antifoam and bactericide additives. These fluids are intended for all-purpose cutting.

General-purpose fluids are opaque emulsions of mineral oil, rust inhibitor additives and possibly antifoam and bactericide additives. These fluids are mainly intended for use as a low-cost cutting fluid in non-severe operations.

Synthetic fluids are transparent or translucent but possibly colored solutions or colloidal dispersions of chemicals which contain no mineral oil. These fluids are intended for heavy duty general use and are most often used for grinding operations.

A very effective soluble oil may be prepared using petroleum sodium sulfonate anionic surfactants as an emulsifier. The sulfonates, along with coemulsifying agents, effectively emulsify the LVI base oils and other water insoluble components used in metal-working fluids. The coemulsifier system, which is known as the soluble oil base, enhances the emulsification performance of the sodium sulfonates and may consist of several different components balanced for the best overall results. General purpose soluble oils contain only base oil plus emulsifiers and their dilute emulsions contain relatively low concentrations of oil. Thus, they have only modest lubrication properties and serve mainly as coolants in metalworking operations. On the other hand, heavy duty soluble oils contain extreme pressure and antiwear additives (fatty materials and sulfur and chlorine-containing compounds) in addition to the base oil and emulsifiers. Thus, their overall metal cutting performance will be much better than that of a general purpose fluid and in rich emulsions will approach that of a neat oil.

Improved performance can be achieved by increasing the additives and/or oil concentration of the cutting fluid. However, this option greatly increases the cost of the cutting field. Thus, a need exists for an improved cutting fluid that has good antirust performance, longer service life and substantially better tool life at high dilution rates. It should also be suitable for grinding operations as well as other machining operations.

The most important characteristic of a metal-cutting fluid is its ability to aid the metal-cutting process; the extent to which it aids this process is usually measured in terms of some combination of the rate of removal of metal, the life of the cutting tool, and the surface finish of the machined part.

It is known, e.g., U.S. Pat. No. 3,509,052, which is incorporated herein by reference, that polyoxyalkylene glycols are useful as demulsifiers in lubricating oil for internal combustion engines.

It is also known, e.g., U.S. Pat. No. 2,958,661, which is incorporated herein by reference, that water soluble non-ionic compounds such as a block polymers of ethylene oxide and propylene oxide are useful as wetting, buffering, solubilizing and load carrying agents in water solutions. However, it was found that such non-ionic compounds were either ineffective in activating the extreme pressure properties of polyalkali metal salts or produce a detrimental effect such as foaming or solution instability.

Surprisingly, I have now found that block copolymers of ethylene oxide and propylene oxide or other alkylene oxides, generally known as polyalkylene glycols, are very effective in improving the metal-cutting ability of an emulsion-type soluble oil.

SUMMARY OF THE INVENTION

In accordance with the invention, there is provided an aqueous metal-working lubricant comprising a major amount of water and a minor amount of an emulsion-type soluble oil comprising a low viscosity index (LVI) lubricating oil; an emulsifier comprising sodium sulfonates; a soluble oil coemulsifier base comprising naphthenic acids, potassium hydroxide, antirust and antimicrobial agents; and an effective amount of block copolymers of ethylene oxide and propylene oxide or other alkylene oxides, generally known as polyalkylene glycols, having a molecular weight between about 800 and about 8,000.

The metal-cutting performance of a semi-synthetic cutting fluid containing an anionic based soluble oil is greatly improved by adding an effective amount of block copolymers of ethylene oxide and propylene oxide or other alkylene oxides.

DETAILED DESCRIPTION

Traditionally, tool life has been improved in anionic soluble oils by the addition of fats and sulfur and chlorine containing additives. However, the traditional fatty additives and sulfurized fats are generally not pure compounds but comlex mixtures of triglycerides containing free fatty acids, other impurities, etc., which can lead to quality control problems. Furthermore, due to the basicity of the current emulsifier system and the presence of water the fats and substituted fatty additives (sulfurized and chlorinated) will hydrolyze to some degree and deteriorate soluble oil performance.

To avoid this problem a new approach of using polyalkylene glycol polymers to improve tool life was tried. Polymers of this type have been used in synthetic water soluble type coolants but apparently have not heretofore been used in a conventional anionic emulsion-type soluble oil. Also the polymers used in the anionic system have to be more oil soluble than those that were applicable in synthetic type coolants.

The copolymers of ethylene oxide and propylene oxide or other alkylene oxides which are contemplated for use in the present invention have a molecular weight between about 800 and 8,000. Less of the higher molecular weight copolymers will be required in a given LVI lubricating oil since they will have a higher viscosity. The viscosity at 100° F. of the block copolymers should be between about 10 and about 500° centistokes. Preferred viscosity at 100° F. will be between about 15 and 250 centistokes. The viscosity of the soluble oil may be adjusted to the level desired by varying the quantity and molecular weight of the block copolymer and by varying the quantity and viscosity of the LVI lubricating oil used. Block copolymers having a molecular weight of between about 1,000 and 4,000 are preferred since smaller adjustments in the quantity and viscosity of the LVI lubricating oil are needed to attain the desired viscosity.

Several commercially available block copolymers of ethylene oxide and propylene oxide or other alkylene oxides can be used in the improved aqueous metal-working lubricants of the invention. The Pluronic series of copolymers, e.g., Pluronic L-101, are available from BASF Wyandotte Corporation, and the UCON series of copolymers, e.g., UCON LB-65, are available from Union Carbide Corporation.

Suitable soluble oils will contain from about 5% wt. to about 30% wt. of low viscosity index (LVI) lubricating oil and from about 10% wt. to about 30% wt. of block copolymers of ethylene oxide and propylene oxide or other alkylene oxides. Preferably the soluble oil will contain from about 10% wt. to about 20% wt. of LVI oil and from about 15% wt. to about 25% wt. of said block copolymers. If too little copolymer is added the tool life suffers while if too much is added the cost becomes excessive.

The LVI lubricant is suitably an LVI 100 Neutral or LVI 65 Neutral which represents a mineral oil having a viscosity at 100° F. in the general range of 100 and 65 SSU respectively.

A suitable soluble oil may be prepared in two parts. Part A is prepared by adding sulfonate. LVI 65 Neutral, UCON LB-65 and Pluronic L-101 and stirring until mixed thoroughly. Part B is prepared by adding water to a soluble oil base comprising co-emulsifiers, such as naphthenic acids, potassium hydroxide (suitably a 45% wt. solution) and suitable antirust and antimicrobial (bactericide) agents. The water is added in an amount to provide solution stability to the polymer-containing soluble oil. The antirust and antimicrobial agents are added in sufficient quantity to provide the desired protection. Part B is mixed until any solids are dissolved. Then Part B is added to Part A and the combination is mixed thoroughly until a clear soluble oil is obtained. Part B comprises about 20% wt. of the soluble oil.

Typical properties of such a soluble oil are as follows:

| | |
|---|---|
| Sp. gravity at 60° F. | 0.99 |
| Viscosity, SSU at 100° F. | 700 |
| Flash Point, COC, ASTM D-92 | 180° F. |
| Water, % v, ASTM D-95 | 15 |

The invention will be further clarified by a consideration of the following example, which is intended to be a complete specific embodiment of the invention and is not to be regarded as a limitation thereof.

EXAMPLE

A combination of polymers of the ethylene oxide-propylene oxide copolymer type (Pluronic L101 ex BASF-Wyandotte and Ucon LB-65 ex Union Carbide) was incorporated into an emulsion-type soluble oil in place of a portion of the base oil to obtain an improved metal-working lubricant. Additional water had to be added to the formulation to obtain satisfactory solution stability of the polymer-containing soluble oil. This new polymer-containing product was designated Blend B (Table 1). An additional formulation with a somewhat lower polymer content, Blend C (Table 1) was also investigated. A soluble oil without the polymers is shown for comparison as Blend A (Table 1). Blend A contains LVI 100 Neutral as a low viscosity index lubricating oil instead of LVI 65 Neutral because the viscosities of Blends B and C are increased by the polymers. Otherwise the formulations are identical except for the polymer.

TABLE 1

| Components, % w | Blend A | Blend B | Blend C |
|---|---|---|---|
| Base components[a] | 9.95 | 9.95 | 9.95 |
| Sodium Sulfonates (40%) | 50.70 | 50.70 | 50.70 |
| | 60.65 | 60.65 | 60.65 |
| LVI 100 Neutral | 39.35 | — | — |
| LVI 65 Neutral | — | 9.70 | 18.20 |
| Ucon LB-65[b] | — | 12.30 | 7.40 |
| Pluronic L-101[c] | — | 7.40 | 3.90 |
| Water | — | 9.95 | 9.95 |
| TOTAL | 100.00 | 100.00 | 100.00 |

[a]Includes co-emulsifiers, naphthenic acids, KOH, antimicrobial agents, corrosion inhibitors and water.

[b]Polyalkylene glycol lubricant believed to be a block copolymer of ethylene oxide and propylene oxide available commercially under the trade name UCON LB-65 (Union Carbide Corporation), having a viscosity at 100° F. of about 12 cs.

[c]Lubricant consisting of block copolymer of ethylene oxide and propylene oxide available commercially under the trade name "Pluronic L-101" (BASF Wyandotte Corporation), having an average mol. wt. of about 3800 and a viscosity at 100° F. of about 250 cs.

Tool life studies were performed to compare the metal-working capability of the polymer-containing formulations with the non-polymer version. Tool life performance was measured in a drilling operation and the data obtained are given in Table 2.

TABLE 2

TOOL LIFE TESTING

| Blend | Dilution Ratio Vol Oil/Vol Water | Test 1[a] Average Number of Holes Drilled | Test 2[b] Average Number of Holes Drilled |
|---|---|---|---|
| A | 1/20 | — | 15 (5) |
| A | 1/40 | 13 (5) | — |
| B | 1/20 | — | 127 (3) |

TABLE 2-continued

| TOOL LIFE TESTING | | | |
|---|---|---|---|
| Blend | Dilution Ratio Vol Oil/Vol Water | Test 1[a] Average Number of Holes Drilled | Test 2[b] Average Number of Holes Drilled |
| B | 1/40 | 71 (3) | 137 (3) |
| C | 1/40 | — | 56 (3) |

[a]Conditions: speed - 600 rpm; feed - 0.006 in./rev; workpiece - 304SS drill - ⅜ in. diameter; hole - one inch depth. Drilling continued until tool failed. Values in parentheses are the number of runs.
[b]Problem with chip formation, feed increased to 0.009 in./rev. All oil conditions the same.

The metal-working lubricant containing only LVI lubricating oil plus emulsifiers and corrosion inhibitors, Blend A, performed rather poorly with an average of only 13–15 holes drilled before tool failure. On the other hand the metal-working lubricants containing block copolymer friction-reducing additives, Blends B and C, greatly increased the number of holes that could be drilled into a metal bar under the given conditions. Tool life increased as block copolymer concentration was increased, as would be expected.

Other embodiments of the invention will be apparent to those skilled in the art from a consideration of this specification or practice of the invention disclosed herein. It is intended that the specification and example be considered as exemplary only, with the true scope and spirit of the invention being indicated by the following claims.

What is claimed is:

1. An aqueous metal-working lubricant comprising a major amount of water and a minor amount of an emulsion-type soluble oil comprising a low viscosity index (LVI) lubricating oil; an emulsifier comprising sodium sulfonates; a soluble oil coemulsifier base comprising naphthenic acids, potassium hydroxide, antirust and antimicrobial agents; and an amount of block copolymers of ethylene oxide and propylene oxide or other alkylene oxides, generally known as polyalkylene glycols, having a molecular weight between about 800 and about 8,000, effective to improve the metal-working capability of said soluble oil.

2. The lubricant of claim 1 wherein the viscosity at 100° F. of the block copolymers is between about 10 and about 500 centistokes.

3. The lubricant of claim 2 wherein the viscosity of the LVI lubricating oil is varied according to the viscosity of the block copolymer to provide suitable viscosity for the soluble oil and suitable lubrication for metal-working.

4. The lubricant of claim 3 wherein the soluble oil contains from about 5% wt. to about 30% wt. of low viscosity index lubricating oil, from about 10% wt. to about 30% wt. of said block copolymers.

5. The lubricant of claim 1 wherein the block copolymers have a molecular weight between about 1,000 and about 4,000.

6. The lubricant of claim 5 wherein the block copolymers have a viscosity at 100° F. of about 15 to about 250 centistokes.

7. The lubricant of claim 1 wherein the ratio of soluble oil to water is between about 1:10 and about 1:40.

8. The lubricant of claim 7 wherein the soluble oil contains from about 10% wt. to about 20% wt. of low viscosity index lubricating oil, from about 15% wt. to about 25% wt. of said block copolymers.

9. The lubricant of claim 8 wherein the block copolymers have a molecular weight between about 1,000 and about 4,000.

* * * * *